US008780000B2

(12) United States Patent
Palacin et al.

(10) Patent No.: US 8,780,000 B2
(45) Date of Patent: Jul. 15, 2014

(54) MULTI-BEAM TELECOMMUNICATION ANTENNA ONBOARD A HIGH-CAPACITY SATELLITE AND RELATED TELECOMMUNICATION SYSTEM

(75) Inventors: Baptiste Palacin, Labege (FR); Xavier Deplancq, Toulouse (FR)

(73) Assignee: Centre National d'Etudes Spatiales, Paris (FR)

( * ) Notice: Subject to any disclaimer, the term of this patent is extended or adjusted under 35 U.S.C. 154(b) by 231 days.

(21) Appl. No.: 13/229,562

(22) Filed: Sep. 9, 2011

(65) Prior Publication Data

US 2012/0075149 A1 Mar. 29, 2012

(30) Foreign Application Priority Data

Sep. 10, 2010 (FR) ..... 10 57193

(51) Int. Cl.
*H01Q 25/00* (2006.01)
*H01Q 1/28* (2006.01)
*H01Q 13/02* (2006.01)

(52) U.S. Cl.
CPC ..... *H01Q 25/007* (2013.01); *H01Q 1/28* (2013.01); *H01Q 13/02* (2013.01)
USPC ..... 343/779; 343/778

(58) Field of Classification Search
CPC ..... H01Q 25/007; H01Q 1/28; H01Q 13/02
USPC ..... 343/778, 779, 781 CA, DIG. 2; 455/12.1, 455/21
See application file for complete search history.

(56) References Cited

U.S. PATENT DOCUMENTS

| | | | | |
|---|---|---|---|---|
| 4,236,161 | A | 11/1980 | Ohm | |
| 6,157,811 | A | 12/2000 | Dent | |
| 7,627,284 | B2 * | 12/2009 | Wang | 455/13.1 |
| 2004/0113838 | A1 * | 6/2004 | Wang et al. | 342/358 |
| 2004/0242152 | A1 * | 12/2004 | Jarett | 455/12.1 |

FOREIGN PATENT DOCUMENTS

| | | | |
|---|---|---|---|
| EP | 1170823 | A1 | 1/2002 |
| EP | 2120281 | A1 | 11/2009 |

OTHER PUBLICATIONS

French Search Report and Written Opinion for application No. 1057193 dated May 17, 2011.

* cited by examiner

*Primary Examiner* — Hoanganh Le
(74) *Attorney, Agent, or Firm* — Patterson & Sheridan, L.L.P.

(57) ABSTRACT

A high-throughput multi-beam telecommunication antenna is configured to cover a geographical area from a geostationary orbit.

It comprises a single reflector and a feed block configured so that each elementary feed is able to generate a different unique beam, the angular separation of any two adjacent primary beams is substantially equal to the angular separation of any two adjacent secondary beams, and the spillover energy losses associated with each source are between 3 and 10 dB, preferably between 3 and 7.5 dB.

12 Claims, 8 Drawing Sheets

MULTI-BEAM TELECOMMUNICATION ANTENNA ONBOARD A HIGH-CAPACITY SATELLITE AND RELATED TELECOMMUNICATION SYSTEM

CROSS-REFERENCE TO RELATED APPLICATIONS

This application claims benefit of French patent application serial number 10 57193, filed Sep. 10, 2010, which is herein incorporated by reference.

BACKGROUND OF THE INVENTION

1. Field of the Invention

The present invention relates to a telecommunication antenna intended to be placed onboard a telecommunication satellite, a payload of a telecommunication satellite comprising the antenna, and a telecommunication system using the payload and therefore the telecommunication antenna.

2. Description of the Related Art

In general and to date in the case of spatial telecommunication using geostationary satellites for the transmission of Ka-band multimedia services, one seeks to broaden the coverage provided by the telecommunication antenna(e) onboard the satellite and to increase the transmission capacity while ensuring a high C/I performance (payload to interfering signal ratio).

To obtain the expected system level performance, it is necessary to have telecommunications antennae that ensure sufficient spatial insulation between beams or their footprints, hereafter called elementary areas or spots, so as to allow reuses programmed in a fixed or dynamic manner of all or part of the frequency resources allocated to the system (reuse of frequencies).

Given the large number of spots to be produced, a large number of directional antennae must be installed on a same satellite platform, and it is also necessary to have large focal structures to achieve high isolation performance between beams associated with a severe pointing stability.

In our time, Ka-band multimedia programs use multiple-reflector antenna solutions. In fact, using several reflectors makes it possible to use large enough feeds to optimally illuminate the reflectors and thereby form fine beams with a high maximal directivity (high antenna efficiency).

The most recent satellite in Europe using this type of antenna is the operator Eutelsat's Ka-sat satellite. It provides European coverage using about 80 beams with a 0.45° angular opening generated by four reflectors measuring 2.6 meters in diameter. Each of these reflectors operates on a forward transmission downlink and on a return reception uplink. This communication system is provided to supply a total capacity of about 70 Gbits/s, the minimum I/C ratio on the coverage being around 14 dB.

It should be noted that the Ka-sat satellite could have used a single reflector measuring 2.6 meters in diameter. In this case, it would have been necessary to produce smaller illumination sources, which would have deteriorated the antenna's efficiency, in particular by increasing energy losses by spillover, typically from 4 to 6 dB. Since the C/I performance remains in the vicinity of 12 dB, the efficiency loss of the antenna would have caused a deterioration of the Effective Isotropic Radiated Power (EIRP), which would amount to a notable and unwanted loss of capacity of the telecommunications system.

Today, several missions are distinguished, from the coverage of a large region, e.g. Europe, to coverage for one or a small number of several European countries.

The study of coverage concerning one to three countries is currently the subject of considerable research and development. For example, the provision of a high-capacity multimedia telecommunication satellite having a coverage area for a country the size of France is contemplated.

In these systems, which are being studied and developed, capacity increases are still being sought through the use of a broader allocated bandwidth when allowed by the regulations, or through the reuse of the spectrum in reduced areas using very fine narrow beams.

Overcoming this gap in terms of capacity then requires the use of more fine beams.

However, the contribution capacities of the current platforms and launch vehicles do not make it possible to consider solutions with multiple reflectors having a diameter greater than 3 or 3.5 meters.

Thus, the use of four reflectors measuring 3.2 meters in diameter currently corresponds to a contribution limit configuration on a satellite to enter a fairing of a launch vehicle.

For this configuration of antennas with four reflectors and by best optimizing the high weight determining parameters of the system, a capacity is obtained of about 65 Gbits/s with 36 beams over France.

In this limit configuration, the feeds are optimized for the four reflectors and the spillover losses are about 2 dB for a minimal C/I in the vicinity of 9 dB.

Moreover, when the number of beams increases, the observed C/I becomes very low and, despite the use of frequencies, the capacity decreases.

The technical problem is to increase the transmission capacity of the satellite under operating conditions of the satellite identical to those presented for the limit configuration in terms of power consumed by the multimedia payload of the satellite, frequency band allocated to the downlink, characteristics of the terminals and mating limitation within a satellite intended to enter a fairing of a launch vehicle.

SUMMARY OF THE INVENTION

The invention relates to a multi-beam telecommunication antenna intended to equip a high-throughput telecommunication payload to cover, in transmission and/or reception, a geographic area from a geostationary orbit, able to be mechanically mounted on one or two satellite platforms and to be electromagnetically coupled to a repeater, comprising:

at least one radioelectric reflector, and an associated feed block, formed by a plurality of elementary radioelectric feeds arranged in a plane, the plurality of elementary radioelectric feeds being configured to illuminate the reflector by electromagnetic radiation in a frequency band and/or to be illuminated by electromagnetic radiation in a frequency band reflected by the reflector according to a primary multi-beam set of adjacent primary beams distributed in at least one spatially connected set of adjacent primary beams, any two adjacent primary beams being separated by a first angular separation $\theta_{S1}$, the reflector being configured to reflect part of the electromagnetic energy emitted by the feed block and/or to intercept part of the electromagnetic energy emitted from the geographical area, according to a secondary multi-beam set of secondary adjacent reflected beams in at least one spatially connected set of adjacent secondary beams, any two adjacent secondary beams being separated by a second angular separation $\theta_{S2}$, characterized in that the reflector is unique, and the feed block is dimensioned and arranged so that each feed can generate and/or receive a different unique beam and so that the first angular separation $\theta_{S1}$ is substantially equal to the second angular separation $\theta_{S2}$, and the spillover energy losses associated with each feed are between 3 and 10 dB, preferably between 3 and 7.5 dB.

According to specific embodiments, the telecommunications antenna includes one or more of the following features:

the reflector is a non-conformed reflector, and the plane in which the radioelectric feeds are arranged is a focal plane of the reflector;

the reflector is a dish portion centered on its dish center of symmetry $C_P$, the focal plane of the reflector in which the radioelectric feeds are arranged is orthogonal to the axis passing through the center of symmetry $C_P$ of the dish and the focal point F1 of the dish, any feed of the feed block has an opening size denoted $T_{source}$, which verifies the relationship $$T_{source} \leq F^* \tan(\theta_{s2}^*(1+\epsilon))$$

in which

F designates the focal distance equal to the distance between the center $C_P$ of symmetry of the dish portion and the focal point F1 of the dish, Θs2 designates the angular separation of two secondary adjacent beams, and ϵ is a numerical coefficient between 0 and +0.35;

the reflector is a portion of a dish shifted relative to the feed block so as to prevent masking of the secondary beams by the feed block, and any feed of the feed block has an opening size denoted $T_{source}$, which verifies the relationship $$T_{source} \leq Feq^* \tan(\theta_{s2}^*(1+\epsilon))$$

in which $F_{eq}$ designates an equivalent focal distance equal to the distance between a cutout center $C_D$ of the dish portion and the focal point F1 of the dish, Θs2 designates the angular separation of two secondary adjacent beams, and ϵ is a numerical coefficient between 0 and +0.35;

the reflector is a portion of a dish, and the feed block comprises at least one set of adjacent radioelectric feeds formed by horns with a circular opening, each horn of the set having a diameter $D_{source}$ including the metallic thickness of the wall of the horn, and the diameter $D_{source}$ of the opening verifies the relationship:

$D_{source}$=Feq*tan($\theta_{s2}$*(1+ϵ)) when the reflector is a portion of a dish shifted relative to the feed block, and the relationship $D_{source}$=F*tan($\theta_{s2}$*(1+ϵ)) when the reflector is a dish portion centered on its dish center of symmetry $C_P$.

in which

F designates the focal distance equal to the distance between the center $C_P$ of symmetry of the dish portion and the focal point F1 of the dish, $F_{eq}$ designates an equivalent focal distance equal to the distance between a cutout center $C_D$ of the dish portion and the focal point F1 of the dish, Θs2 designates the angular separation of two secondary adjacent beams, and ϵ is a numerical coefficient between 0 and +0.35;

the feed block and the reflector are configured to operate in a frequency band included in the set of bands C, Ku, Ka;

the arrangement of the radioelectric feeds in the plane is that of a configuration corresponding to an optimized distribution for a number of colors equal to 3, 4 or 7;

the minimum value on the geographical coverage of the C/I ratio between, on the one hand, the energy transmitted and/or received by the reflector in any secondary beam, and on the other hand, the sum of the energies transmitted and/or received in the same secondary beam and transmitted and/or received by the reflector from the other beams of the same color as the secondary beam, is below 15 dB, preferably below 12 dB.

The invention also relates to a telecommunication payload intended to transmit and/or receive high-throughput data, comprising a transmission and/or reception antenna as defined above and a repeater, characterized in that the repeater comprises a set of transmission and/or reception transmission links, each transmission link comprising an output and/or radioelectric input terminal connected to a single radioelectric feed and different from the feed block, and being configured to provide radioelectric signals in a frequency sub-band B(i) among a predetermined number Nb of frequency sub-bands forming an allocated frequency band, and in that each sub-band B(i) being associated with a color, the transmission links are able to distribute, in transmission and/or reception, the frequency sub-bands to the set of elementary radioelectric feeds so that the ground diagram formed by the colors associated with the different secondary beams generated by the antenna is a diagram with Nb colors for optimized frequency reuse, i.e. a diagram for which the angular distance between two beams using a same color is the greatest over all of the possible diagrams.

The invention also relates to a satellite telecommunication system comprising:

a telecommunication satellite equipped with a payload as defined above, a set of telecommunication terminals able to transmit and/or receive radioelectric signals towards/from the satellite, one or more satellite gateway stations able to transmit and/or receive radioelectric signals to/from terminals through the satellite following a forward and/or return uplink, and each terminal is able to determine the C/I+N ratio observed by its respective antenna and/or by the satellite antenna between, on the one hand, the received energy C associated with the wanted radioelectric signal of the terminal and contained in the secondary coverage beam of the terminal, and on the other hand, the sum I of the energies received in the same secondary beam but transmitted from the other secondary beams of the same color as the feed associated with the secondary coverage beam of the terminal and the energy N of the thermal noise received, and comprises a device for adapting the throughput received or transmitted as a function of the observed conditions of C/I+N, the throughout being variable by modifying the number of states of a modulation and/or the encoding rate and/or the symbol throughput.

BRIEF DESCRIPTION OF THE DRAWINGS

The invention will be better understood upon reading the description of a single embodiment that follows, provided solely as an example and done in reference to the drawings, in which.

DETAILED DESCRIPTION

Figure 1:
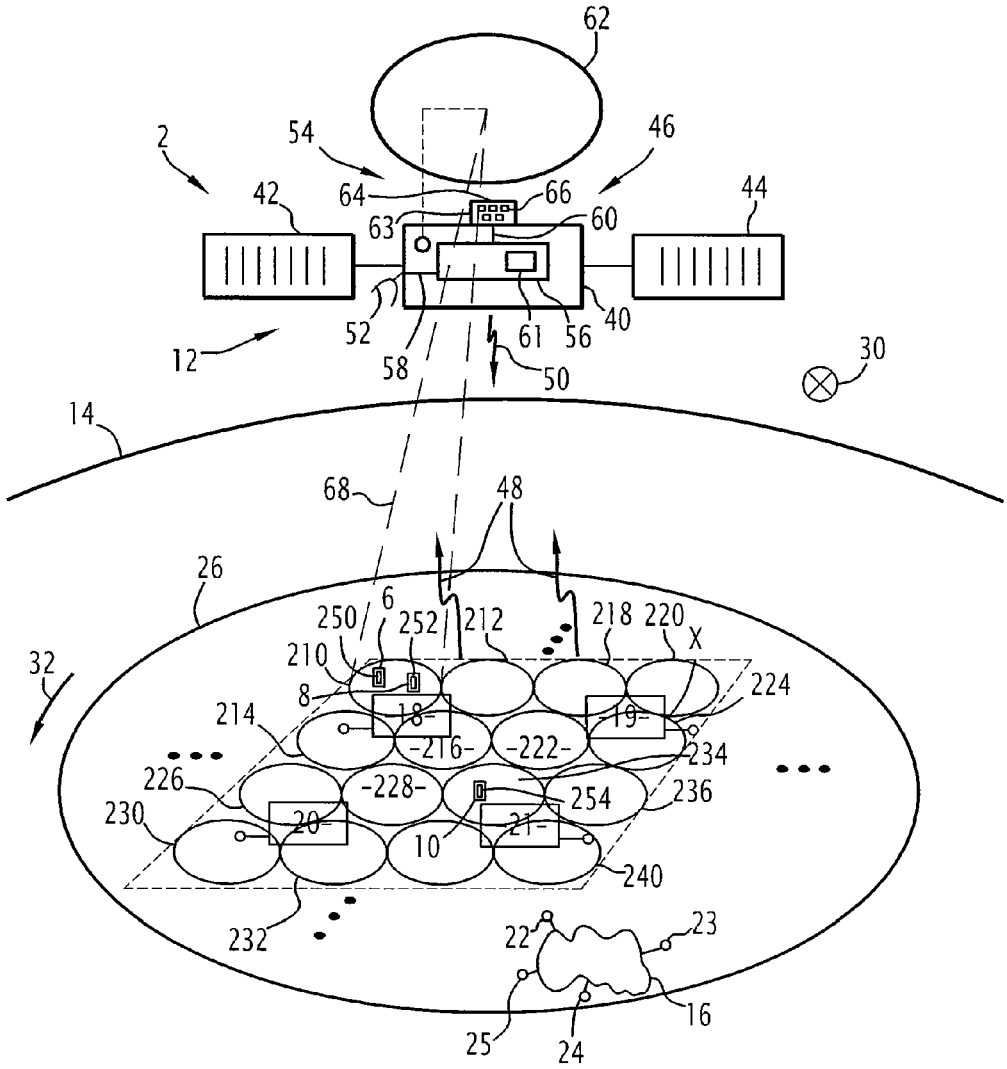
FIG. 1 is a general view of the architecture of a telecommunication system with a geostationary satellite according to the invention.

According to FIG. 1, a telecommunication system 2, here for multimedia services, with a satellite comprises a set 4 of multimedia terminals 6, 8, 10, a satellite 12 in geostationary orbit around the Earth 14, a multimedia ground infrastructure 16, and several gateways 18, 19, 20, 21 to the satellite, each connected to the ground infrastructure 16 by a different communication link, not shown, in respective connection terminals 22, 23, 24, 25.

The multimedia system 2 is supposed to serve a small geographical coverage area 26, between 500,000 $km^2$ and 1,500,000 $km^2$.

Typically, this corresponds for the northern hemisphere to one, two or three countries each the size of France.

Here, as an example, the coverage area 26 for the telecommunication service is France, and it is between the meridians situated at 5° west and 6° east, between latitudes 43° north and 51° north.

The geostationary satellite 12 in geostationary orbit around the Earth 14 is placed on a first arc of the geostationary orbit close to or contained in a second geostationary arc flying over the end meridians surrounding France. Here, over FIG. 1 the geostationary satellite 12 is situated on a median meridian passing through the center of France.

Relative to the coverage area 26, the satellite 12 is situated along a southern geographical direction 30 shown by the end arrow going towards the back of the plane of FIG. 1. A northern direction 32, opposite the southern direction 30, is shown by an arrow circumferential to the surface of the Earth 14.

Figure 2:
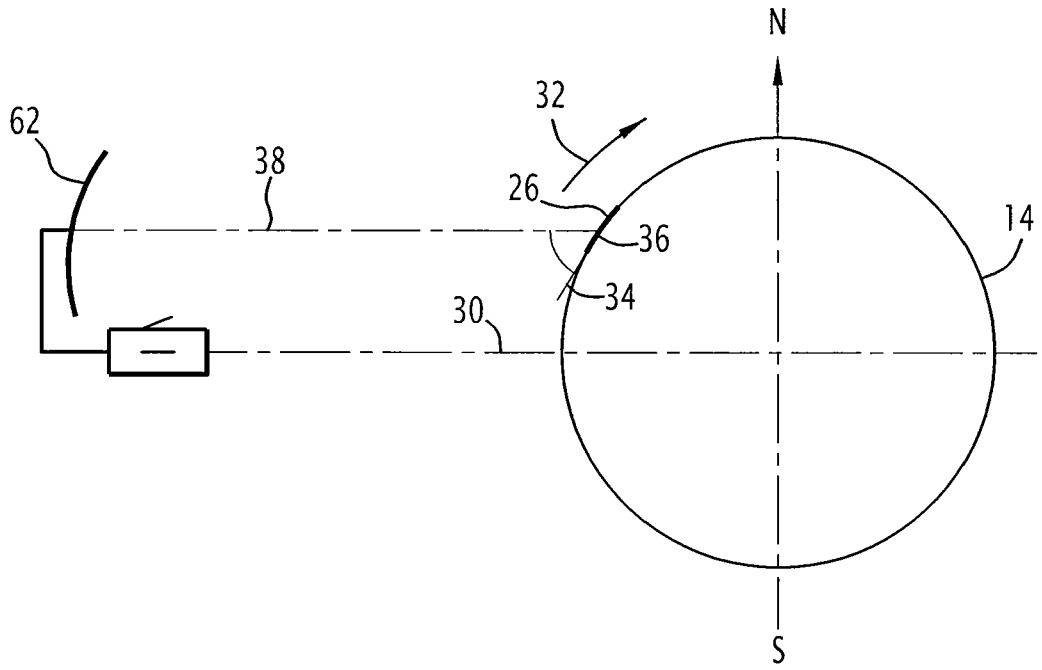
FIG. 2 is a geometric view of the satellite and service coverage making it possible to view the elevation angle of the satellite seen from any point of the coverage.

From the coverage area 26, the satellite 12 is seen along an angle of elevation designated by El and shown in FIG. 2 as a mean angle between the tangent along the longitudinal direction 34 and any point 36 of the coverage 26 and the vector ray 38 connecting the point 36 of the coverage 26 and the satellite 12.

According to FIG. 1, the satellite 12 comprises a stabilized geostationary platform 40, two solar panels 42, 44 and a multimedia telecommunication payload 46.

The payload 46 can ensure the retransmission of multimedia services from the gateways 18, 19, 20, 21 towards the multimedia terminals 6, 8, 10.

The payload 46 is able to receive multimedia signals transmitted on an uplink 48 in a first band Ka by the gateways 18, 19, 20, 21.

The payload 46 is able to transmit the received multimedia signals intended for the terminals 6, 8, 10 along a downlink 50 operating in a second band Ka, distinct from the first band Ka.

The payload 46 here is transparent and limited to the amplification and frequency transposition of the multimedia signals.

The payload 46 comprises a multimedia reception satellite antenna 52, a multimedia transmission satellite antenna 54, and a multimedia mission repeater 56 connected between the multimedia reception satellite antenna 52 and the multimedia transmission satellite antenna 54 by electrical links 58 and 60.

The multimedia repeater 56 comprises an electrical power source 61 for the payload 46 able to condition the electrical energy provided by the solar panels 42, 44 for the component electrical elements of the payload 46.

The multimedia transmission satellite antenna 54 is a multi-beam reflector antenna.

It comprises a single reflector 62 having a focal plane 63 distant from a focal length F and a feed block 64 including a plurality of elementary feeds 66 of a predetermined number Ns.

The single reflector 62 is able to intercept part of the electromagnetic energy transmitted by the feed block 64 and to reflect the electromagnetic energy towards the coverage area 26 in downwards multi-beams.

The reflector 62 is unique and has a visible diameter D of 5 meters so as to form beams with an angular size between 0.10° and 0.22°.

In fact, it is well known that the opening angle of a beam generated by an aperture having a visible diameter is proportionate to the wavelength of the radiation and inversely proportionate to the visible diameter. Here, the aperture is the reflector 62.

The elementary radioelectric feeds 66 are arranged in the focal plane 63 and are able to illuminate the single reflector 62 by an electromagnetic radiation in a frequency band Ka or Ku.

The feed block 64 is of the single feed per beam (SFB) type, each feed being able to generate a different unique beam and the diameter of each elementary feed being equal to the image diameter in the focal plane of the associated beam.

In general and in everything that follows, an electromagnetic energy beam is called "primary" when it is established between an elementary feed 66 of the feed block 64 and the reflector 62, and the beam is called "secondary" when it is established between the reflector 62 and an elementary area of the coverage 26, independently of the direction of propagation of the energy in the beam, i.e. the transmission or reception mode of the antenna 46.

The arrangement of the reflector 62 relative to the platform 40, the orbital position and the stabilized altitude of the platform 40, the configuration of the antenna are chosen so that the antenna 54 generates downward secondary beams covering, by their footprint, the geographical coverage area 26 corresponding to France.

The plurality 64 of elementary radioelectric feeds 66 forming the feed block is configured to illuminate the reflector 62 by an electromagnetic radiation according to a primary multibeam set of primary adjacent beams, not shown in FIG. 1, distributed into at least one spatially connected set of adjacent primary beams, any two adjacent primary beams being separated by a first angular separation.

The reflector 62 is configured to intercept part of the electromagnetic energy transmitted by the feed block 64 and to reflect it according to a secondary multi-beam set of secondary adjacent reflected beams 68 distributed in at least one spatially connected set of adjacent secondary beams, any two adjacent secondary beams being separated by a second angular separation.

The feed block 64 is dimensioned and arranged so that the first angular separation is substantially equal to the second angular separation. The relative variation between the first angular separation and the second angular separation is smaller than 25%.

Strictly speaking, the first angular separation and the second angular separation are connected by the relationship:

$$\theta_{s2}=\theta_{s1}\cdot\mathrm{BDF},$$

in which $\theta_{s2}$ designates the second angular separation, $\theta_{s1}$ designates the first angular separation, and BDF is a coefficient called beam deviation factor smaller than 1 and depends on the ratio F/D and the apodization of the elementary feed.

In practice, the coefficient BDF is between 0.7 and 1.

Here, a single downward secondary beam 68 is shown in broken lines.

The spillover energy losses associated with each feed 66 are between 3 and 10 dB, preferably between 3 and 7.5 dB.

Each feed 66 is distinguished using a whole index k, with k varying between 1 and Ns, and denoted S(k). Each feed S(k) is able to receive a distinct set of multimedia signals in a transmission sub-band B(i) taken from a set of Nb distinct sub-bands and without a recovery band, the set of sub-bands (B(i)) constituting a partition of the transmission band of the forward downlink, i.e. a partition of the second band.

Each feed S(k) is able to illuminate the reflector so as to reconvey the signals along the forward downlink 50 over a different associated elementary area S(k) of the coverage area 26.

FIG. 1 here shows only 16 elementary areas forming a partial connected tiling of the coverage area 26 and designated by references 210, 212, 214, 216, 218, 220, 222, 224, 226, 228, 230, 232, 234, 236, 238, 240.

The optimal use of the allocated frequency spectrum on the forward downlink 68 in terms of capacity is obtained by the reuse of frequencies through the multi-beam antenna 54.

The multi-beam antenna 54, with a single reflector 62 and a feed block of the "single feed block" (SFB) type, as described above, makes it possible to reuse frequencies.

The reuse of the same frequency band over several elementary areas of the coverage area 26 requires that isolation performance of the multi-beam antenna 54 be taken into account.

In fact, the isolation between adjacent beams being difficult to obtain, it is not possible to reuse the same frequency band for it. The frequency band allocated for multimedia service or the second band is partitioned and a reuse of 1/Nb is defined, in which Nb designates a number of different colors, by associating a color with a subset of elementary areas (also called spots), disjointed and distant from each other so as to have sufficient isolation. Each different color is assigned a whole index i, with i varying from 1 to Nb, and a subset of elementary areas A(i) or beams F(i). The reuse makes it possible to spatially separate two beams using the same carrier frequency or sub-band.

A breakdown or distribution of the Nb colors over the elementary areas or the downward beams, "optimal" in terms of reuse frequency and minimal C/I, is chosen among the possible distributions of Nb colors over all of the beams and therefore all of their footprints, i.e. the elementary coverage areas.

The "optimal" distribution of the Nb colors is optimal in terms of reuse frequency when the reuse frequency of each color is substantially the same, i.e. equal to 1/Nb, the edge effects being negligible when the number of elementary areas is high.

An "optimal" distribution of Nb colors is optimal in terms of C/I when the C/I over the coverage 26 is maximal over the set of possible distributions of Nb colors over all of the beams.

The use of the multi-beam antenna 54 with a single large reflector 62 having a diameter greater than 4 meters using the single feed per beam (SFB) concept is advantageous.

In fact, the multi-beam antenna 54 makes it possible, for a fixed frequency reuse factor and an optimal reuse scheme, to increase the system's capacity.

The proposed telecommunication antenna is certainly sub-optimal from an antenna subsystem perspective if it is considered in an isolated manner. In fact, the spacing between the spots of the coverages requires the use of feeds with small diameters. They are thus not very directional and cause heavy losses in terms of spillover, between 5 and 6 dB.

This solution makes it possible to contemplate a number of beams over the much greater coverage because they are finer than in the already-known solutions.

In first approach, the capacity of a multi-beam system satisfies the following relationship:

$$C=B(\mathrm{total})*\eta=B(\mathrm{allocated})*\rho*\eta$$

in which B (total) designates the total available band expressed in Hz, B(allocated) designates the allocated frequency band according to the regulatory provisions for the second band, ρ designates the frequency reuse factor, η designates the spectral efficiency expressed in bits/s/Hz.

The spectral efficiency η depends on the frequency density of EIRP (Effective Isotropic Radiated Power) expressed in W/MHz, the C/I, the figure of merit of the terminal and therefore of the ratio C/N, N designating the observed noise of thermal origin, and the contemplated waveform.

The total available band increases with the number of beams on the coverage.

The spectral efficiency decreases with the number of beams due to a lower C/I over all of the beams and therefore with the degradation of C/N+I.

Here, the multi-beam antenna 54 allows capacity gains in terms of increase of the number of beams despite greater spillover energy losses.

The two multimedia terminals 6, 8 are situated in the elementary area 210.

The third terminal 10 is situated in the elementary area 234, here assumed as an example to be assigned the same color, i.e. operating in a same frequency sub-band of the second band.

Thus, the C/I observed by the third terminal 10 comprises a component generated by the signals of the terminals 6 and 8, and received due to the lack of isolation of the beam 68 covering the elementary area 210 with the beam covering the elementary area 234.

Each terminal has a G/T factor, equal to 16.4 dB/° K, and an antenna gain equal to 40 dB, which corresponds to an antenna diameter of about 65 cm.

Each terminal 6, 8, 10 respectively comprises a throughput adaptation device 250, 252, 254 as a function of the observed C/I conditions.

Each throughput adaptation device is able to implement a throughput adaptation mode, typically the "ACM" mode of the DVB-S2 described in the corresponding standard of the ETSI (European Telecommunication Standard Institute).

A modulation can be chosen as a function of the C/I+N observed among the QPSK modulation (Quadrature Phase Shift Keing), 8-PSK modulation (8-Phase Shift Keing), 16-APSK modulation (16-Amplitude & Phase Shift Keing) and 32-APSK modulation (32-Amplitude & Phase Shift Keing). The encoding can vary between levels 1/4 and 9/10 proposed by the LDPC code used in standard DVB-S2.

In this example, the adaptive encoding level associated with the QPSK modulation can vary between 3/4 and 8/9.

In this example, the adaptive encoding level associated with the 8-PSK modulation can vary between 3/5 and 3/4.

Due to the low values of C/I that can be observed with the multi-beam antenna 54, i.e. values that can reach a minimal C/I equal to +9 dB, the throughput adaptation devices 250, 252, 254 make it possible to use modulation/encoding combinations with a spectral efficiency making it possible to maximize the system's capacity.

Contrary to what is known the multimedia telecommunication system according to the invention works with low spectral efficiency values.

Increasing the redundancy on the error corrector code, i.e. the encoding level from 8/9 to 3/4 or from 3/4 to 3/5, or decreasing the number of states of the modulation, i.e. from eight to four different phase states, causes, for a same frequency band, a decrease in the throughput but makes it possible to operate for a much lower signal to noise ratio requiring less power or making it possible to operate with a low C/I going up to +9 dB.

According to the invention, it is more interesting up to a certain limit to increase the frequency band allocated to the terminals (in particular by multiplying the number of elementary areas) even if it means damaging the spectral efficiency. The capacity of the system then obtained is 42% better than the capacity of the typical case in which the minimal C/I over the global coverage 26 is equal to 15 dB.

It should be noted that the capacity increases significantly for a minimal C/I below 13 dB when it is possible to increase the number of beams.

In fact, the ACM (Adaptive Coding and Modulation) mode defined in standard DVB-S2 requires lower payload power increases C and/or decreases in the received noise component N+I to go from one modulation and encoding configuration to another when the operating point of the system corresponds to an area with lower C/N+I values. In other words, low variations of C/N+I can contribute a more significant spectral efficiency gain when the system operates in a low value area of C/N+I. In this way, it is possible to generate particularly fine beams as proposed with the antenna according to the invention.

Figure 3:
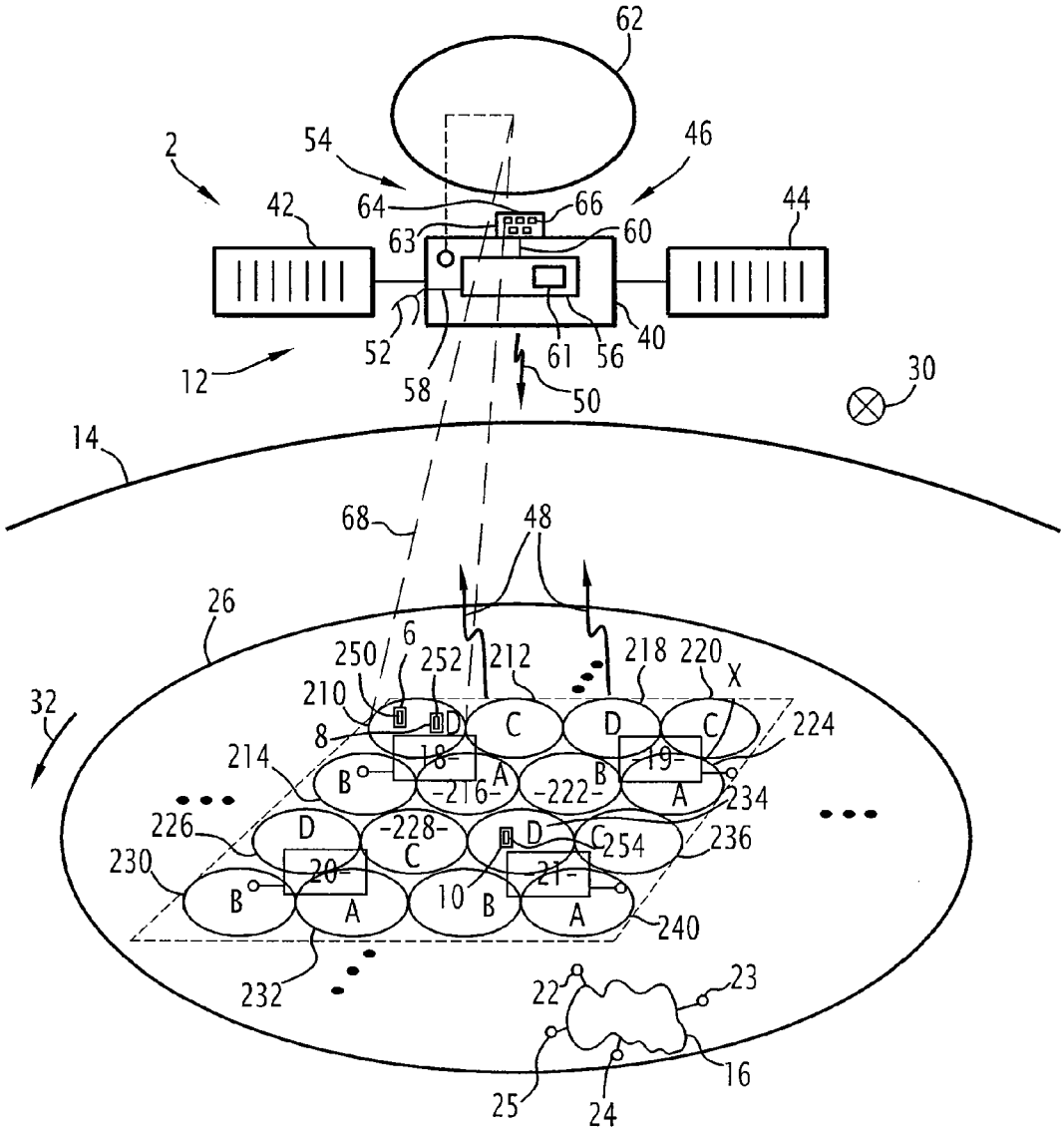
FIG. 3 is a partial view of the coverage of the telecommunication antenna of the satellite of FIGS. 1 and 2 with the distribution of the frequencies associated with the beams according to a four-color configuration.

According to FIG. 3, the number Nb of sub-bands is equal to 4 and the distribution of the four colors associated with the four frequency sub-bands B(i) is an "optimal" breakdown or distribution of four colors in terms of reuse frequency and minimal C/I.

The distribution of the "four colors" as shown is the "optimal" distribution among the possible distributions of four colors over all of the beams and therefore all of their footprints, i.e. the elementary coverage areas.

The "optimal" distribution of four colors is optimal in terms of reuse frequency when the reuse frequency of each color is substantially the same, i.e. equal to one quarter, the edge effects being negligible when the number of elementary areas is high enough.

A distribution of four colors is called "optimal" in terms of C/I when the minimal C/I value over the entire coverage observed for that distribution is a maximal value over all of the possible distributions with four colors. This corresponds to a maximal angular distance between any two beams having the same color, i.e. using the same sub-band.

The spots or footprints of the beams are grouped together in elementary clusters of four adjacent spots of different colors along a same geometric pattern or spatial arrangement of the four colors.

Here in FIG. 3, only four adjacent clusters 302, 304, 306, 308 repeating the pattern of colors four times are shown.

The first cluster 302 comprises the four elementary coverage areas 210, 212, 214, 216 respectively operating on the forward downlink 50 in the sub-bands B(4), B(3), B(3), B(1) to which the colors respectively designated by letters D, C, B, A are allocated.

The second cluster 304 comprises four elementary coverage areas 218, 220, 222, 224 respectively operating on the forward downlink 50 in the sub-bands B(4), B(3), B(2), B(1) to which the colors respectively designated by letters D, C, B, A are allocated.

The third cluster 306 comprises the four elementary coverage areas 226, 228, 230, 232 respectively operating on the forward downlink 50 in the sub-bands B(4), B(3), B(2) B(1) to which the colors respectively designated by letters D, C, B, A are allocated.

The fourth cluster 308 comprises the four elementary coverage areas 234, 236, 238, 240 respectively operating on the forward downlink 50 in the sub-bands B(4), B(3), B(2) B(1) to which the colors respectively designated by letters D, C, B, A are allocated.

Each elementary coverage area is the footprint of a different image beam, generated only by a unique elementary feed different from the feed assembly.

Thus, an effective frequency reuse is obtained in which the minimal C/I obtained over the entire coverage is the greatest possible over all of the possible allocation laws for the four colors.

In the case of a single reflector having a diameter equal to 5 meters, the size of the feeds is such that all of the beams are generated by the set of feeds situated in the same focal plane and the spillover energy losses are minimal for the set of feeds. This corresponds to placing the centers of the feeds so as to generate the central radius of each beam of the coverage and to choose the radius of the largest possible feeds until they come into contact.

Because there is less space to place the feeds with a single reflector than with several reflectors, the sizes of the feeds corresponding to the single reflector have been reduced relative to the sizes of the feeds corresponding to several reflectors, and the corresponding spillover energy losses have increased.

Figure 4:
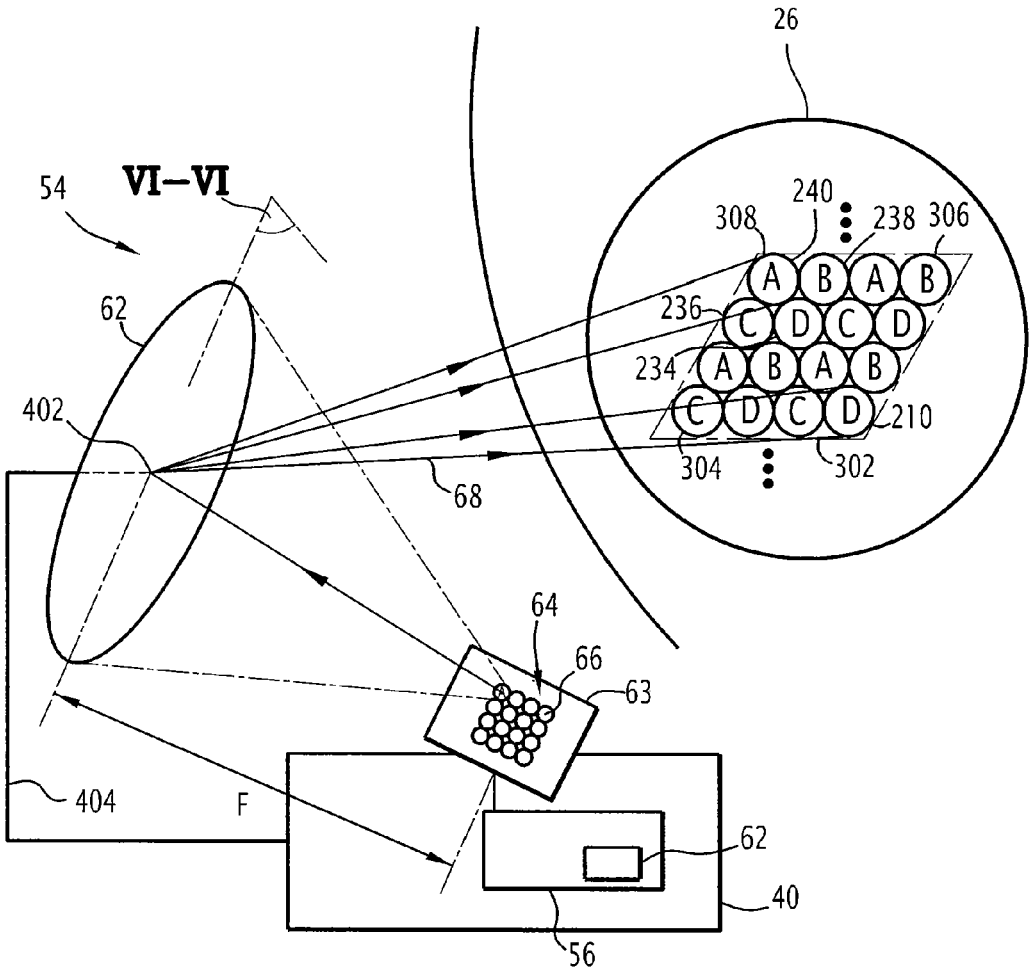
FIG. 4 is a diagram of the telecommunication system making it possible to view the connection between the distribution of the sub-bands over the feeds of the antenna and the distribution of the sub-bands on the beams of the downlink going from the satellite to the terminals.
Figure 5:
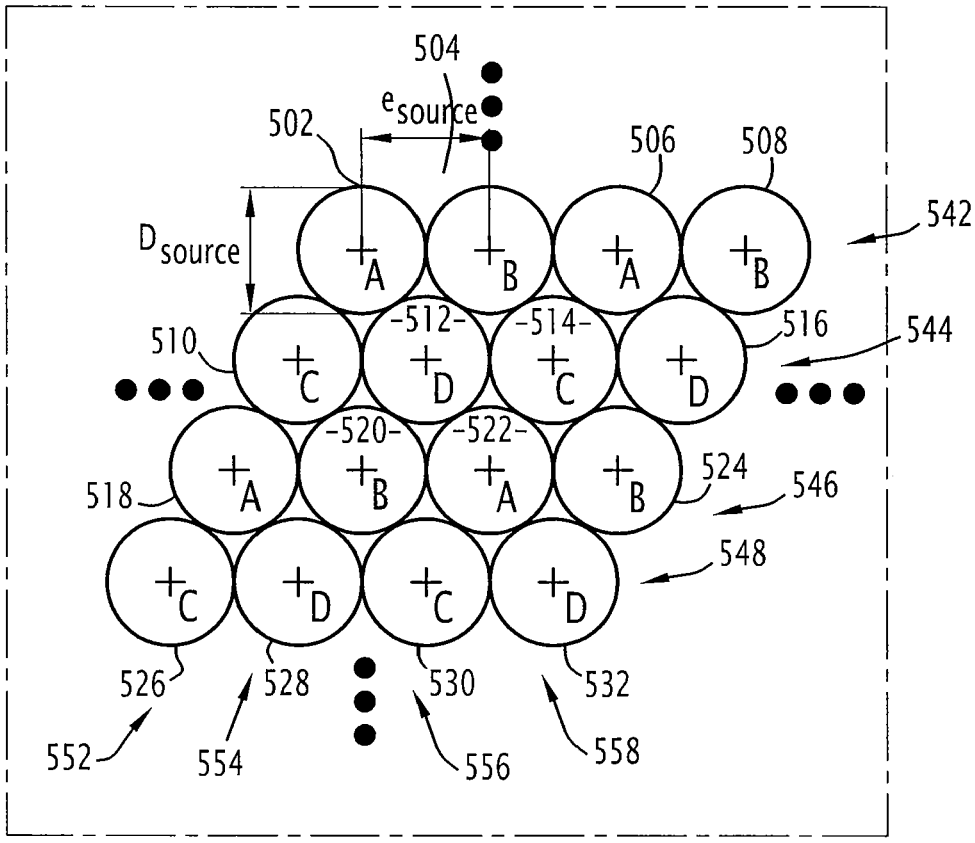
FIG. 5 is a view of the feed block of the antenna of FIG. 4 configured according to a four-color distribution.

According to FIGS. 4 and 5, the multi-beam antenna 54 is shown in more detail so as to show the correspondence between the network 64 of feeds 66 and the distribution of the beams on the service coverage 26 according to the elementary areas and the four-color coloring described in FIG. 3.

According to FIG. 5, the feed block 64 or focal network comprises at least one spatially connected set of elementary feeds. The elementary feeds 66 here are horn-type antennae.

Here, only sixteen feeds are shown, designated by references 502, 504, 506, 508, 510, 512, 514, 516, 518, 520, 522, 524, 626, 528, 530, 532, 534, 536, 538, 540.

The arrangement of the radioelectric feeds in the focal plane is that of a configuration corresponding to the optimized distribution of the sub-bands for the four colors designated by letters A, B, C and D.

Feeds 502, 504, 506, 508 are arranged side by side in a first row 542. Feeds 510, 512, 514, 516 are arranged side by side in a second row 544. Feeds 518, 520 522, 524 are arranged side by side in a third row 544. Feeds 526, 528, 530, 532 are arranged side by side in a fourth row.

The four rows 542, 544, 546, 548 are arranged side by side so that the feeds 502, 510, 518, 526 form a first column 552 perpendicular to the shared direction of the four rows 542, 544, 546, 548.

Likewise, feeds 504, 512, 520, 528 form a third column 556, feeds 508, 516, 524, 532 form a fourth column 558.

Color A is assigned to feeds 502, 506, 518, 522. Color B is assigned to feeds 504, 508, 520, 524. Color C is assigned to feeds 510, 514, 526, 530. Color D is assigned to feeds 512, 516, 528, 532.

Feeds 502, 504, 510, 512 respectively correspond to the elementary areas 240, 238, 236, 234 of the fourth cluster 308.

Feeds 506, 508, 514, 516 correspond to the elementary areas of the third cluster 306.

Feeds 518, 520, 526, 528 correspond to the elementary areas of the second cluster 306.

Feeds 506, 508, 514, 516 correspond to the elementary areas of the first cluster 306.

Figure 6:
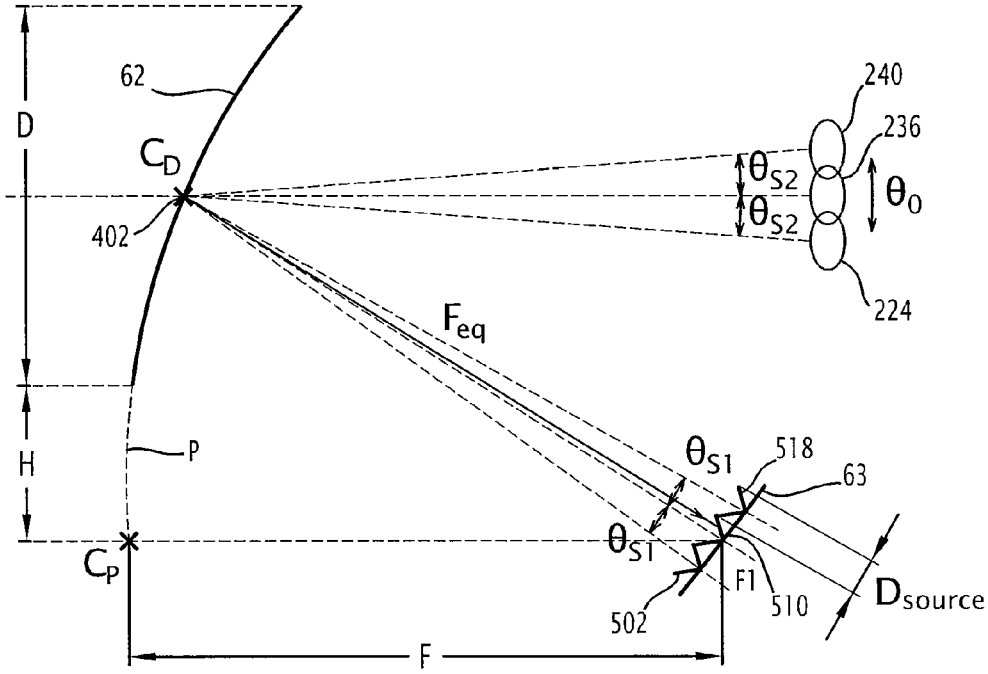
FIG. 6 is a view of a cross-section of the antenna of FIG. 4 along axis VI-VI.

According to FIGS. 4 and 6, the reflector 62 is a reflector with a pliable rigid shell or mesh technology that can be accommodated on a platform in a mating position in which the assembly formed by the platform and the reflector is contained in the fairing of a launch vehicle.

The single reflector 62 can be deployed from the embarked mating position on a platform to a deployment position shown in FIGS. 4 and 6.

Here, the reflector 62 is a position of a dish P shifted relative to the feed block 64 so as to prevent masking by the feed block 64 of the secondary beams, here the beams descending towards the coverage area 26.

The dish portion is for example an elliptical cutout of the dish. The center of the dish and the focal point of the dish are respectively designated by $C_P$, and F1, while the cutout center is designated by $C_D$.

According to FIG. 6, the clearance height of the feed block 64 relative to the reflector 62 is designated by H. The apparent diameter of the reflector 62, designated by D, is equal to the size of the projected surface obtained by orthogonal projection of the surface of the reflector in the plane containing $C_P$ and having as normal the axis passing through $C_P$ and the focal point F1.

When the shape of the cutout is elliptical, the cutout point $C_D$ is situated at a height equal to H+D/2 relative to the axis passing through the center $C_P$ and the focal point F1.

The focal distance designated by the letter F is equal to the distance between the center $C_P$ of symmetry of the dish portion and the focal point F1 of the dish.

The equivalent focal distance, designated by Feq, is equal to the distance between the cutout center $C_D$ of the dish portion P and the focal point F1 of the dish P.

In FIG. 6, cross-sectional views show only the three elementary feeds 502, 510 and 518 and correspondingly to the associated elementary areas 240, 236, 224.

As mentioned for FIG. 1, the angular separation angle between two adjacent primary beams, shown in FIG. 6 by θs1 for the first pair of feeds 501 and 510 and for the second pair of feeds 510 and 518, is substantially equal to the angular separation angle between two adjacent secondary beams, shown in FIG. 6 by θs2 for the first pair of corresponding elementary areas 240 and 236 and the second pair of corresponding elementary areas 236 and 224.

Hereafter θs1 and θs2 will be designated identically by θs. In a first approximation, the reflector can be considered to be governed by the laws of geometric optics and then the dimension or size of the feeds is governed by the following relationship:

$$D_{source} \leq Feq * \tan(\theta_{s2}/\mathrm{BDF})$$

in which $D_{source}$ designates the opening diameter of the circular horn forming an elementary feed of the spatially connected set of elementary feeds.

Preferably, the opening diameter $D_{source}$ of the horn verifies the relationship:

$D_{source}$=Feq*tan($\theta_{s2}$/BDF) because the diameter $D_{source}$ solution of this equation corresponds to the case where the spillover of the feed is lowest. For a given beam size, this is the solution making it possible to reduce the spillover losses of the antenna.

Alternatively, the reflector is a dish portion centered on its dish center of symmetry $C_P$. The focal plane of the reflector in which the radioelectric feeds 66 are arranged is orthogonal to the axis passing through the center of symmetry $C_P$ of the dish and the focal point F1 of the dish. Any elementary feed 66 of the feed block 64 has an opening size denoted $T_{source}$, which verifies the relationship $$T_{source} \leq F * \tan(\theta_{s2}/\mathrm{BDF}).$$

Alternatively, the elementary feeds are openings having a closed contour with any shape having a size denoted $T_{source}$, and corresponding to an equivalent diameter.

The focal length F separating the focal plane 63 and the cutout center 402 ($C_D$) of the reflector 62 here is between 4 meters and 7 meters.

This results, however, in a high level of spillover because this effect is primarily related to the use of one single reflector. This amounts to a significant degradation of the efficiency or effectiveness of the antenna.

The term representative of the degradation of the antenna's efficiency through spillover, called spillover coefficient, translates the degree of suitability of the feed diagram to the angle under which the latter sees the reflector, and this term is equal to the ratio between the energy effectively intercepted to the total energy radiated by said feed.

According to the invention, in the case of a reflector with 5 meters and a focal length equal to 7 meters, the reflector 62 only captures about one quarter of the energy coming from the feeds 66 and the spillover coefficient is equal to about 0.25, which gives spillover losses between 5 and 6 dB.

Advantageously and unexpectedly, such an antenna configuration makes it possible to increase the capacity of a multimedia system covering a geographic area the size of France.

In fact, such an antenna respects the mating requirement within the satellite intended to enter the fairing of the launch vehicle and the power input limited onboard the satellite.

Traditionally, solutions are known using a beam forming network (BFN) to generate a multi-beam coverage using a large single reflector and providing a quality spillover coefficient. This beam forming network BFN makes it possible to interlace the feeds and optimally light the reflector.

Traditionally, two solutions allow optimal illumination of the reflector.

In a first solution, a "low-level" BFN is arranged before the power amplification section of the payload. In this case the number of amplification devices is equal to or a multiple of the number of feeds of the focal network, which is itself greater than the number of beams of the coverage. Lastly, the feeds have a diameter identical to the image diameter of the beams in the focal plane.

The use of such a "low-level" BFN requires a large number of amplifiers greater than the number of beams to be formed over the coverage. As a result, the limitations in terms of power consumption and heat dissipation onboard current platforms will limit the number of beams over the coverage. Thus, the limitation of electrical power available onboard the satellite translates to a decrease in the output power of a level higher than the gain obtained by improving the spillover coefficient and the obligation to downwardly revise the number of beams.

In a second solution, a "high-level" BFN is arranged after the amplification section of the repeater paths each corresponding to a beam. In that case, the number of amplification devices is equal to the number of beams of the coverage. Lastly, the elementary feeds are twice as small as the image diameter of the beam in the focal plane. One drawback of this solution is the existence of a minimal diameter of the feeds due to the limitation of the focal length of the reflector. With such a solution, the spillover coefficient has a value below the spillover coefficient of the inventive configuration, i.e. a single feeder per beam (SFB), and this leads to revising the number of beams.

Thus the known solutions using a single reflector for multibeam coverage do not make it possible to benefit from the optimal capacity that can be achieved with reflector diameters greater than 4 meters, given the mating requirement when the satellite is embarked within the launch vehicles and limited electrical consumption on the current platforms.

Thus, accepting a degradation of the link budget in terms of degradation of the spillover coefficient and degradation of the C/I, the spillover coefficient being between 5 and 6 dB and the C/I being between +9 dB and +23 dB, leads to the inventive solution, i.e. a single-reflector antenna and a SFB-type feed set making it possible to increase the number of beams and the capacity while respecting the mating requirement when the satellite is embarked on the traditional launch vehicles and the consumption limitations on the existing platforms.

Figure 7:
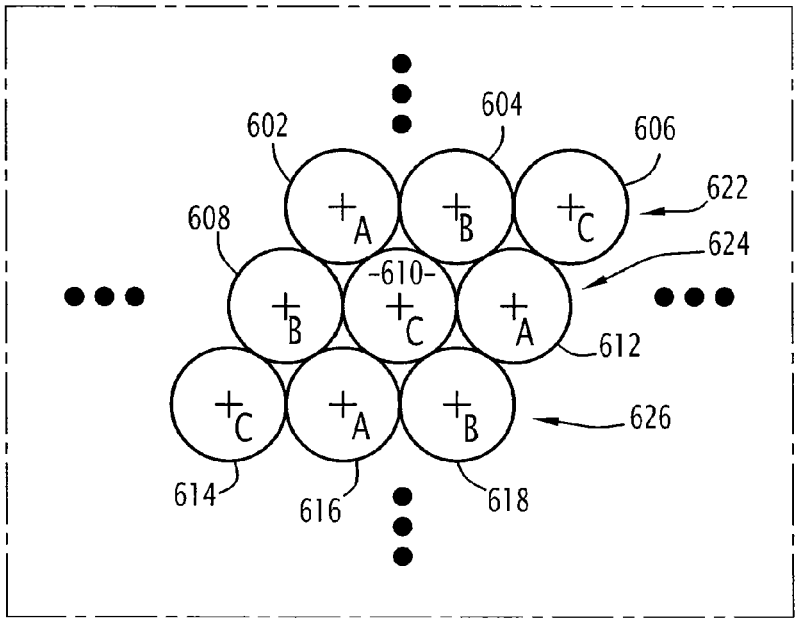
FIG. 7 is a three-color variation of the feed block of FIG. 5.

According to FIG. 7, alternatively to FIG. 5, a feed block comprises a single connected set of adjacent radioelectric feeds formed by horns.

Here, only nine feeds are shown, designated by references 602, 604, 606, 608, 610, 612, 614, 616, 618.

The arrangement of the radioelectric feeds in the focal plane is that of a configuration corresponding to the optimized distribution of the sub-bands for three colors designated by letters A, B and C.

Feeds 602, 604, 606, respectively feeds 608, 610, 612 and feeds 614, 616, 618 are arranged in a first row, respectively a second row and a third row.

The feeds of two consecutive rows are globally shifted by a length equal to one radius of a feed, so that for example the feeds 602, 604, 610 form an equilateral triangle. This configuration using a color distribution mesh or ternary pattern having the shape of an equilateral triangle corresponds to an optimal frequency reuse diagram for which the use frequency of the three colors and the minimal C/I are the largest over the angular coverage generated by the set of beams from the feeds.

Figure 8:
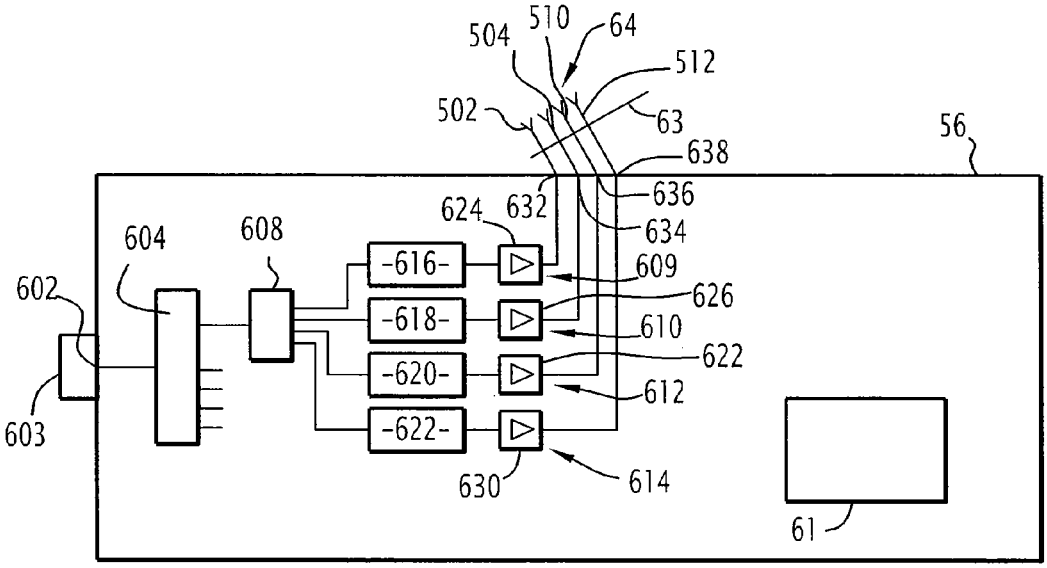
FIG. 8 is a partial view of the repeater of the satellite and its electrical coupling to the feed block of the antenna.

According to FIG. 8, the repeater 56 of each payload comprises an input 602 for the reception antenna 52 of the forward uplink through its feed 603, a first frequency demultiplexing device 604 for the signals coming from two different satellite gateway stations connected to the input 602 of the reception antenna.

The repeater 56 also comprises, for each set of signals received and transmitted by a same access station, a second frequency demultiplexing device 606 of the signals intended for different descending beams, here four and corresponding to a same cluster of elementary areas on four different elementary output power links.

Here, for simplification and as an example, a single second frequency demultiplexing device 606 has been shown with its four elementary output power links 608, 610, 612, 614.

In fact, it is assumed here that the signals intended for a same descending beam are transmitted in a same rising frequency sub-band of the forward uplink, and that the rising frequency sub-bands associated with the descending beams of a same cluster of elementary areas are juxtaposed to form a frequency band associated with a cluster.

Each output power elementary transmission link 608, 610, 612, 614 comprises a unique transposition device 616, 618, 620, 622 followed by an associated power amplification means 624, 626, 628, 630, able to deliver the output power to the feed of the corresponding beam.

For example, the feeds connected to the output terminals of the output power elementary transmission links are the feeds of FIG. 5 designated by 502, 504, 510, 512.

The other elementary feeds of the feed assembly, like feeds 502, 504, 510, 512, are connected to a single and different output power elementary transmission link. Thus, the repeater is configured to power each feed of the antenna 54 on a single unique conveyance link for the descending traffic and intended for the corresponding elementary area.

Each output power amplification means 624, 626, 628, 630 here is a Traveling Wave Tube Amplifier (TWTA) operating in Ka band.

Each TWTA 624, 626, 628, 630 is able to amplify a sub-band or color among the four colors of the second allocated band, each sub-band having a bandwidth of 1450 MHz and able to deliver an output power of 170 W.

Each TWTA here is used on an operating point taken at 3 dB back-off, the output losses between the output of the TWTA and the input of the feed being equal to 2.6 dB.

In general, the transposition devices are configured to provide each output power elementary transmission link with radioelectric signals in a frequency sub-band B(i) among a predetermined number N of frequency sub-bands forming an allocated frequency band. Each sub-band B(i) being associated with a color, the frequency transposition means is able to distribute the frequency sub-bands to the output transmission bands and to all of the elementary radioelectric feeds so that the ground diagram formed by the colors associated with the different beams generated by the diagram is an optimized diagram with N frequency reuse colors, i.e. a diagram for which the angular distance between two beams using a same color is greatest over all of the possible diagrams.

Figure 9:
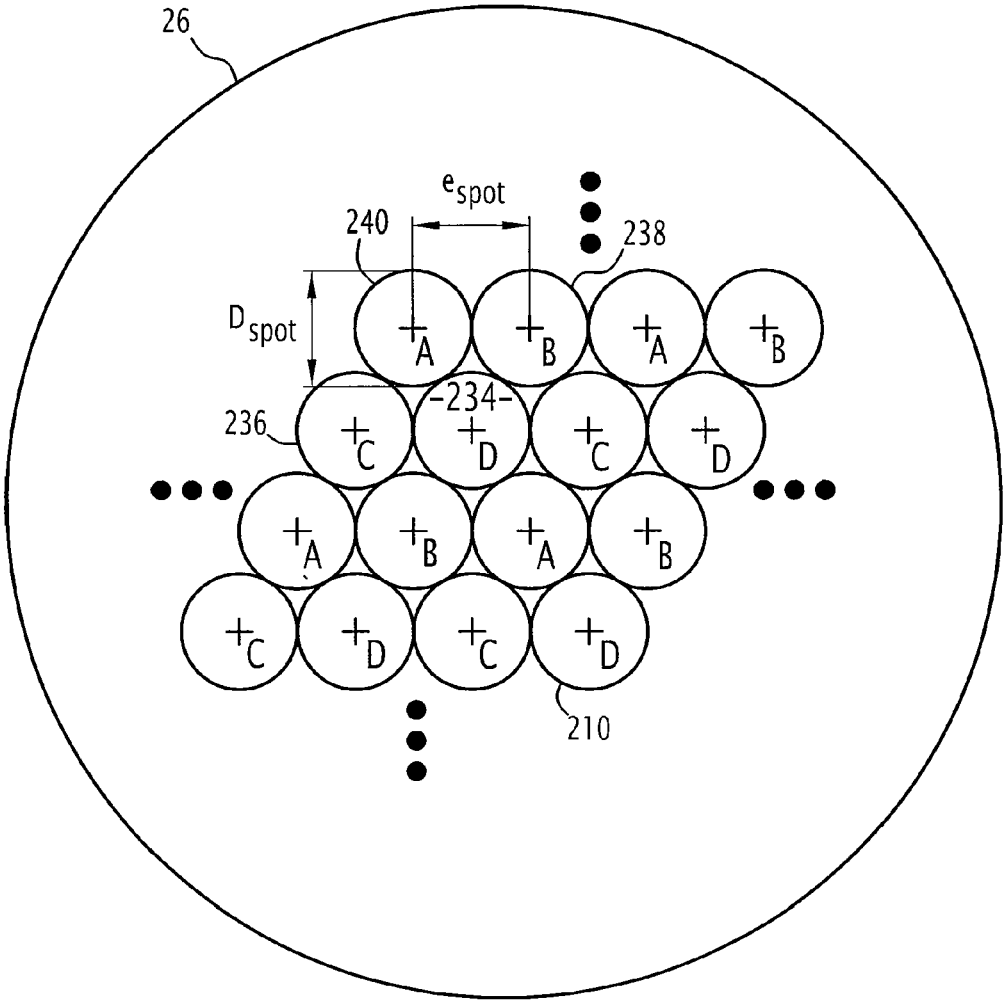
FIG. 9 is a partial view of the service coverage obtained with the satellite of FIG. 2 equipped with the telecommunication antenna of FIGS. 4 and 5, and the four-color feed block of FIG. 5.

According to FIG. 9, the global coverage is broken down into 62 elementary areas for which the greatest total capacity on the forward downlink is obtained.

This maximal total capacity, equal to about 100 Gbits/s, is obtained for tiling of the coverage area in 62 elementary areas, subject to the use of a frequency reuse factor equal to 4, an electric power available onboard the satellite for a payload equal to 12 kW, a minimal admissible C/I equal to 9 dB.

This maximal capacity is reached when the terminals have a G/T factor equal to 16.4 dB/° K, an antenna gain equal to 40 dB, and uses both modulation and adaptive encoding defined according to ETSI standard DVB-S2 (European Telecommunication Institute).

Alternatively, the telecommunication antenna and the payload are configured to operate in C band.

Alternatively, the antenna operates in reception mode. In that case, the plurality 64 of elementary radioelectric feeds 66 is configured to be illuminated by the reflector 62 by an electromagnetic radiation in a frequency band according to a primary multi-beam assembly of adjacent primary beams distributed in at least one spatially connected set of adjacent primary beams, any two adjacent primary beams being separated by a first angular separation. The reflector 62 is configured to intercept part of the electromagnetic energy transmitted from the geographic area 26, according to a secondary multi-beam set of secondary adjacent reflected beams distributed in at least one spatially connected set of adjacent secondary beams, any two adjacent secondary beams being separated by a second angular separation. The first angular separation and the second angular separation are substantially equal.

Alternatively, the telecommunications antenna is configured to operate in transmission and reception with a same reflector.

Alternatively, the reflector is a conformed reflector and the elementary feeds forming the feed block are arranged in a mean plane with distance deviations around this mean plane depending on the conformation of the reflector.

Alternatively, the telecommunication system comprises two satellites configured in a "formation flight." The reflector is mounted on a first satellite while the feed block and the payload are mounted on a second satellite.

The invention claimed is:

1. A multi-beam telecommunication antenna intended to equip a high-throughput telecommunication payload to cover, in transmission and/or reception, a geographic area from a geostationary orbit, able to be mechanically mounted on one or two satellite platforms and to be electromagnetically coupled to a repeater, comprising:

at least one radioelectric reflector, and an associated feed block, formed by a plurality of elementary radioelectric feeds arranged in a plane, the plurality of elementary radioelectric feeds being configured to illuminate the reflector by electromagnetic radiation in a frequency band and/or to be illuminated by electromagnetic radiation in a frequency band reflected by the reflector according to a primary multi-beam set of adjacent primary beams distributed in at least one spatially connected set of adjacent primary beams, any two adjacent primary beams being separated by a first angular separation $\theta_{S1}$, the reflector being configured to reflect part of the electromagnetic energy emitted by the feed block and/or to intercept part of the electromagnetic energy emitted from the geographical area, according to a secondary multi-beam set of secondary adjacent reflected beams in at least one spatially connected set of adjacent secondary beams, any two adjacent secondary beams being separated by a second angular separation $\theta_{S2}$, wherein the reflector is unique, and the feed block is dimensioned and arranged so that each feed can generate and/or receive a different unique beam and so that the first angular separation $\theta_{S1}$ is substantially equal to the second angular separation $\theta_{S2}$, and the spillover energy losses associated with each feed are between 3 and 10 dB.

2. The multi-beam telecommunication antenna according to claim 1, wherein the reflector is a non-conformed reflector, and the plane in which the radioelectric feeds are arranged is a focal plane of the reflector.

3. The multi-beam telecommunication antenna according to claim 2, wherein the reflector is a dish portion centered on its dish center of symmetry $C_P$, the focal plane of the reflector in which the radioelectric feeds are arranged is orthogonal to the axis passing through the center of symmetry $C_P$ of the dish and the focal point F1 of the dish, any feed of the feed block has an opening size denoted $T_{source}$, which verifies the relationship $$T_{source} \leq F^* \tan(\theta_{S2}^*(1+\epsilon))$$

in which

F designates the focal distance equal to the distance between the center $C_P$ of symmetry of the dish portion and the focal point F1 of the dish, Θs2 designates the angular separation of two secondary adjacent beams, and ϵ is a numerical coefficient between 0 and +0.35.

4. The multi-beam telecommunication antenna according to claim 2, wherein the reflector is a portion of a dish shifted relative to the feed block so as to prevent masking of the secondary beams by the feed block, and any feed of the feed block has an opening size denoted $T_{source}$, which verifies the relationship $$T_{source} \leq Feq^* \tan(\theta_{s2}^*(1+\epsilon))$$

in which $F_{eq}$ designates an equivalent focal distance equal to the distance between a cutout center $C_D$ of the dish portion and the focal point F1 of the dish, Θs2 designates the angular separation of two secondary adjacent beams, and ϵ is a numerical coefficient between 0 and +0.35.

5. The multi-beam telecommunication antenna according to claim 2, wherein the reflector is a portion of a dish, and the feed block comprises at least one set of adjacent radioelectric feeds formed by horns with a circular opening, each horn of the set having a diameter $D_{source}$ including the metallic thickness of the wall of the cone, and the diameter $D_{source}$ of the opening verifies the relationship:

$D_{source}$=Feq*tan($\theta_{s2}$*(1+ϵ)) when the reflector is a portion of a dish shifted relative to the feed block, and the relationship $D_{source}$=F*tan($\theta_{s2}$*(1+ϵ)) when the reflector is a dish portion centered on its dish center of symmetry $C_P$, in which F designates the focal distance equal to the distance between the center $C_P$ of symmetry of the dish portion and the focal point F1 of the dish, $F_{eq}$ designates an equivalent focal distance equal to the distance between a cutout center $C_D$ of the dish portion and the focal point F1 of the dish, Θs2 designates the angular separation of two secondary adjacent beams, and ϵ is a numerical coefficient between 0 and +0.35.

6. The multi-beam telecommunication antenna according to claim 1, wherein the feed block and the reflector are configured to operate in a frequency band included in the set of bands C, Ku, Ka.

7. The multi-beam telecommunication antenna according to claim 6, wherein the minimum value on the geographical coverage of the C/I ratio between, on the one hand, the energy transmitted and/or received by the reflector in any secondary beam, and on the other hand, the sum of the energies transmitted and/or received in the same secondary beam and transmitted and/or received by the reflector from the other beams of the same color as the secondary beam, is less than 15 dB.

8. The multi-beam telecommunication antenna according to claim 7, wherein the minimum value on the geographical coverage of the C/I ratio is less than 12 dB.

9. The multi-beam telecommunication antenna according to claim 1, wherein the arrangement of the radioelectric feeds in the plane is that of a configuration corresponding to an optimized distribution for a number of colors equal to 3, 4 or 7.

10. A telecommunication payload intended to transmit and/or receive high-throughput data, comprising a transmission and/or reception antenna according to claim 1 and a repeater, wherein the repeater comprises a set of transmission and/or reception transmission links, each transmission link comprising:

an output and/or radioelectric input terminal connected to a single radioelectric feed and different from the feed block, and being configured to provide radioelectric signals in a frequency sub-band B(i) among a predetermined number Nb of frequency sub-bands forming an allocated frequency band, and in that each sub-band B(i) being associated with a color, the transmission links are able to distribute, in transmission and/or reception, the frequency sub-bands to the set of elementary radioelectric feeds so that the ground diagram formed by the colors associated with the different secondary beams generated by the antenna is a diagram with Nb colors for which the angular distance between two beams using a same color is the greatest over all of the possible diagrams.

11. A telecommunication system comprising:

a telecommunications satellite equipped with a payload according to claim 10, a set of telecommunications terminals able to transmit and/or receive radioelectric signals towards/from the satellite, one or more satellite gateway stations able to transmit and/or receive radioelectric signals to/from terminals through the satellite following a forward and/or return uplink, wherein each terminal is able to determine the C/I+N ratio observed by its respective antenna and/or by the satellite antenna between, on the one hand, the received energy C associated with the wanted radioelectric signal of the terminal and contained in the secondary coverage beam of the terminal, and on the other hand, the sum I of the energies received in the same secondary beam but transmitted from the other secondary beams of the same color as the feed associated with the secondary coverage beam of the terminal and the energy N of the thermal noise received, and comprises a device for adapting the throughput received or transmitted as a function of the observed conditions of C/I+N, the throughout being variable by modifying the number of states of a modulation and/or the encoding rate and/or the symbol throughput.

12. The multi-beam telecommunication antenna according to claim 1, wherein the spillover energy losses associated with each feed are between 3 and 7.5 dB.

* * * * *